United States Patent [19]

Yarwood et al.

[11] 4,415,017

[45] Nov. 15, 1983

[54] CONTROL OF LIQUID-SOLID INTERFACE IN ELECTROMAGNETIC CASTING

[75] Inventors: John C. Yarwood, Madison; Gary L. Ungarean, Woodbridge; Derek E. Tyler, Cheshire, all of Conn.

[73] Assignee: Olin Corporation, New Haven, Conn.

[21] Appl. No.: 277,759

[22] Filed: Jun. 26, 1981

[51] Int. Cl.[3] ..... B22D 11/16; B22D 11/00

[52] U.S. Cl. ..... 164/453; 164/455; 164/503

[58] Field of Search ..... 164/414, 449, 453, 455, 164/467, 503, 507

[56] References Cited

U.S. PATENT DOCUMENTS

| | | | |
|---|---|---|---|
| 3,204,460 | 9/1965 | Milnes | 164/449 |
| 3,467,166 | 9/1969 | Getselev et al. | 164/467 |
| 3,478,808 | 11/1969 | Adams | 164/453 X |
| 3,605,865 | 9/1971 | Getselev | 164/467 |
| 3,706,399 | 12/1972 | Sundberg | 164/449 X |
| 3,838,727 | 10/1974 | Levi et al. | 164/453 |
| 4,014,379 | 3/1977 | Getselev | 164/467 |
| 4,015,128 | 3/1977 | Della Vedova | 164/449 X |
| 4,066,114 | 1/1978 | Dorr et al. | 164/453 |
| 4,132,259 | 1/1979 | Poncet | 164/449 X |
| 4,158,379 | 6/1979 | Yarwood et al. | 164/467 |
| 4,161,206 | 7/1979 | Yarwood et al. | 164/467 |

FOREIGN PATENT DOCUMENTS

| | | | |
|---|---|---|---|
| 2854515 | 6/1979 | Fed. Rep. of Germany | 164/449 |
| 2024063 | 1/1980 | United Kingdom | 164/467 |
| 273226 | 4/1967 | U.S.S.R. | 164/453 |

OTHER PUBLICATIONS

"Automatic Control of DC Casting with a Programmable Controller Based System", Magistry et al., Light Metals, AIME, vol. 2, 1979, pp. 665–669.

*Primary Examiner*—Gus T. Hampilos
*Assistant Examiner*—Jerold L. Johnson
*Attorney, Agent, or Firm*—Howard M. Cohn; Barry L. Kelmachter; Paul Weinstein

[57] ABSTRACT

An electromagnetic casting system for casting materials comprising the apparatus and process for electromagnetically containing and forming molten material during a casting run into a desired shape. During the casting run, a liquid-solid interface defines molten material head and solid material portions of the casting. The electromagnetic containing and forming device includes an inductor applying a magnetic field to the molten material. The magnetic field defines a containment zone for the molten material. An alternating current is applied to the inductor to generate the magnetic field. The improvement comprises controlling the location of the liquid-solid interface in the containment zone. The location of the liquid-solid interface along the periphery of the casting is monitored. In response to the monitored location, in a first mode of operation when the liquid-solid interface varies from the desired set point less than a desired percentage of the inductor length, only the coolant addition is varied to keep the location of the liquid-solid interface substantially constant. In a second mode of operation when the liquid-solid interface varies from the desired set point more than the desired percentage, both the flow rate of molten metal and the coolant addition are changed to return the location of the liquid-solid interface to the desired set point. Upon return of the liquid-solid interface to the set point, cycling back to the first mode of operation occurs.

8 Claims, 1 Drawing Figure

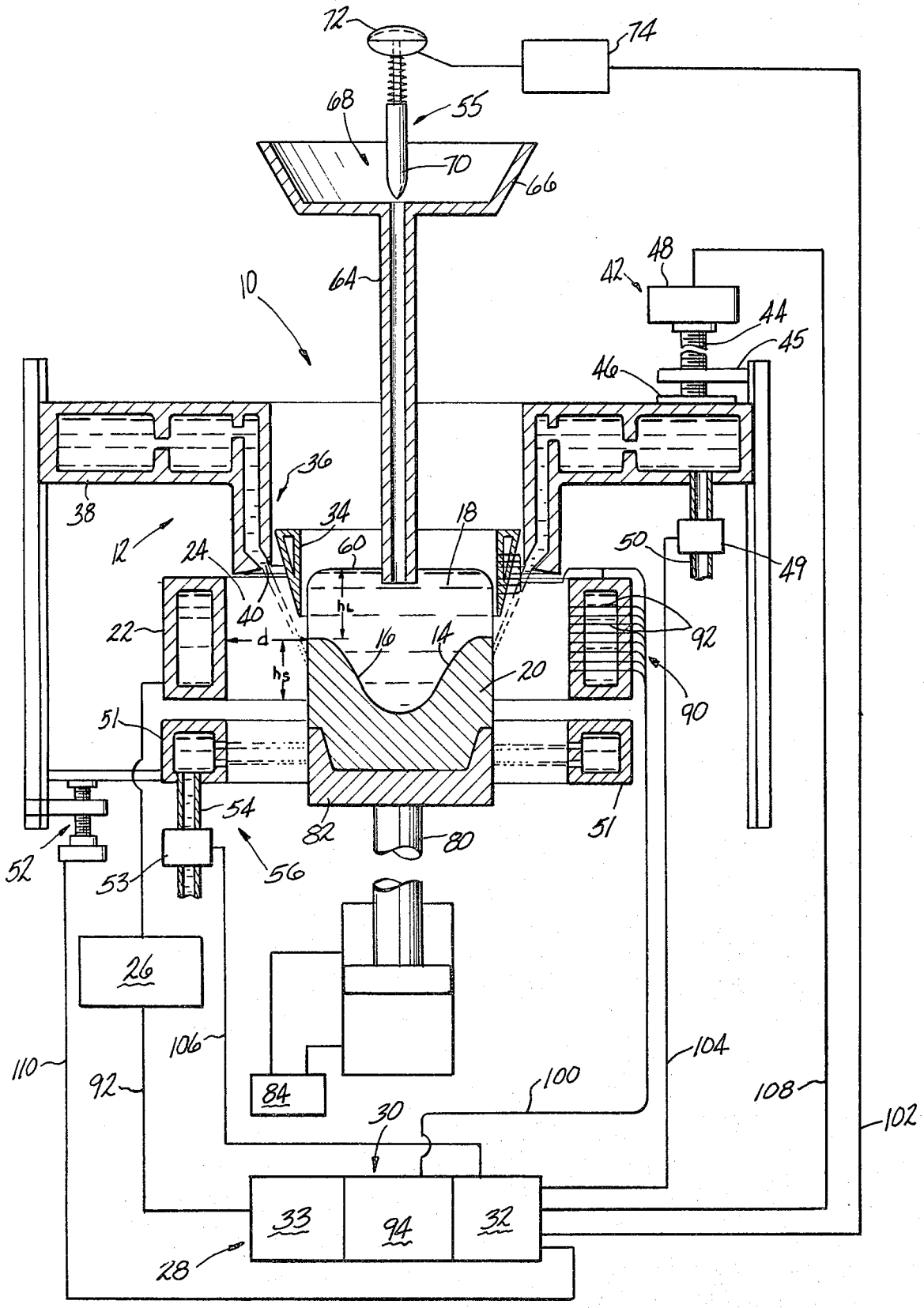
72
74
68
55
70
66
64
10
42
48
44
45
46
36
38
34
18
12
24
60
50
49
40
22
d
16
14
92
20
90
51
54
82
80
51
52
53
56
26
106
104
110
92
84
100
108
102
30
33
94
32
28

CONTROL OF LIQUID-SOLID INTERFACE IN ELECTROMAGNETIC CASTING

While the invention is subject to a wide range of applications, it is especially suited for automatically controlling the liquid-solid interface of a casting in an electromagnetic casting mold and will be particularly described in that connection. The process and apparatus may be applied to electromagnetic casting equipment in order to position the mold elements and to select and fix the operating conditions during the electromagnetic casting run.

The basic electromagnetic casting apparatus comprises a three-part mold consisting of a water cooled inductor, a non-magnetic screen, and a manifold for applying cooling water to the cast ingot. Such an apparatus is exemplified in U.S. Pat. No. 3,467,166 to Getselev et al. Containment of the molten metal is achieved without direct contact between the molten metal and any component of the mold. Solidification of the molten metal is achieved by direct application of water from the cooling manifold to the ingot shell.

In electromagnetically casting molten materials, high levels of control of system parameters are generally desirable to obtain high quality surface shape and condition as well as metallurgical structural tolerances. In the past, the electromagnetic casting art has included a variety of techniques and associated equipment to control the cast ingot. A sampling of these techniques and equipment are described herein below.

It is known in the art to control the ingot diameter or cross section during the casting process by control of inductor current in accordance with the teachings of U.S. Pat. No. 4,014,379 to Getselev which sets forth, for example, "a method of forming an ingot in the process of continuous and semi-continuous casting of metals consisting in that the molten metal is actuated by an electromagnetic field of an inductor, in which case the current flowing through the inductor is controlled depending on the deviations of the dimensions of the liquid zone of the ingot from a prescribed value, and thereafter, the molten metal is cooled down." A similar technique is disclosed in U.S. Pat. No. 4,161,206 to Yarwood et al. which discloses, for example, "an apparatus and process for casting metals wherein the molten metal is contained and formed into a desired shape by the application of an electromagnetic field. A control system is utilized to minimize variations in the gap between the molten metal and an inductor which applies the magnetic field. The gap or an electrical parameter related thereto is sensed and used to control the current to the inductor."

Control of the level of molten metal in an electromagnetic casting environment is disclosed in U.S. patent application Ser. No. 110,893 to Ungarean et al. now abandoned. The application discloses, for example, that "the hydrostatic pressure exerted by the molten metal in the containment zone is sensed and in response thereto the flow of molten metal into the containment zone is controlled. This minimizes changes in the hydrostatic pressure."

It is also known to sense the level of the molten metal as well as the liquid-solid interface of a casting in an electromagnetic casting environment as set forth in U.S. Pat. No. 4,321,922 to Ungarean et al. The application discloses, for example, "a process and apparatus for determining the value of parameters which affect emissivity of radiation from a metal load in an electromagnetic casting system. Infrared radiation being emitted from the surface of the load is sensed by an array of fiber optic filaments secured within elements of the electromagnetic casting system. Radiation signals are transmitted by the filaments to a signal processor which enables readout display of electromagnetic casting parameters such as liquid temperature, maximum load temperature, position of the liquid/solid interface, and head position."

Also, U.S. patent application Ser. No. 137,645 to Kindlmann et al. now abandoned, discloses a technique by which the height of the liquid metal head as well as the location of the liquid-solid interface can be determined for a casting being cast in an electromagnetic casting apparatus.

Once the liquid-solid interface is located, in accordance with the principles set forth in the patents mentioned above, it may be necessary to change the location of the interface. U.S. Pat. No. 4,158,379 to Yarwood et al. discloses an electromagnetic continuous or semi-continuous casting device wherein, for example, a "coolant application system may be adjustably positioned to control the solidification front at the surface of the casting without otherwise influencing the containment process through modification of the magnetic field". The solidification front may also be positioned in accordance with the teachings in U.S. Pat. No. 4,388,962 to Yarwood et al.

It is also known to shape the electromagnetically contained molten material by selective screening of the magnetic field in accordance with U.S. Pat. No. 3,605,865 to Getselev. Further, the effect of the screen itself can be varied in accordance with the principle disclosed in U.S. Pat. No. 4,161,206 to Gaule et al.

The rate of withdrawal of the casting from the electromagnetic casting device may be controlled as generally described in U.S. Pat. No. 4,353,408 to Pryor.

In order that the ingot geometry and metallurgical quality are uniform throughout the cast product, it is important that the electromagnetic molding equipment be set up so that the initial conditions are selected and fixed prior to the start-up of the electromagnetic casting run. This concept is taught in U.S. patent application Ser. No. 229,031 to Yarwood et al. now abandoned.

In the area of DC casting, a programmable control of DC casting parameters such as casting speed and water flow has been disclosed in an article entitled "Automatic Control of DC Casting with a Programmable Controller Based System" by Magistry et al., Light Metals, AIME, Vol. 2, 1979, pages 665–669. This reference discloses the concept of listing parameters and a code number on a card which can be ready by a controller to adjust the casting speed and the flow rate of the coolant.

Another system of interest is U.S. patent application Ser. No. 277,771 to Pryor, wherein a system for electromagnetically forming material in molten form is disclosed providing a priority system for maintaining the hydrostatic pressure of the molten material at a desired level.

During the casting of an ingot using the electromagnetic casting apparatus and procedure, the position of the liquid-solid interface is preferably maintained relatively constant in order to generate a uniform desirable metallurgical structure in the ingot. The interface position in influenced by a variety of factors including, among others, coolant application position, coolant rate, coolant temperature, casting speed, and liquid metal temperature. The casting speed or withdrawal rate is often deliberately varied through periods of acceleration and deceleration at the beginning and end of a cast. Accordingly, the withdrawal rate of the casting from the mold may be difficult to vary in order to control the liquid-solid interface position. The liquid metal temperature may be changed but with some difficulty. The coolant application position, coolant rate, and coolant temperature have been described in the prior art set forth hereinabove as a means for changing the interface position. In the event that rapid repositioning of the liquid-solid interface is required, the techniques and concepts already disclosed in the electromagnetic casting art may be inefficient or slow to meet the demand in the required time frame.

It is a problem underlying the present invention to provide an electromagnetic casting system which is able to generate a uniform desirable metallurgical structure in the ingot.

It is an advantage of the present invention to provide an electromagnetic casting system which substantially obviates one or more of the limitations and disadvantages of the described prior arrangement.

It is a further advantage of the present invention to provide an electromagnetic casting system which controls the location of the liquid-solid interface in the containment zone.

It is a still further advantage of the present invention to provide an electromagnetic casting system which maintains the liquid-solid interface near the maximum magnetic field in the containment zone.

Accordingly, there has been provided an electromagnetic casting system for casting materials comprising the apparatus and process for electromagnetically containing and forming molten material during a casting run into a desired shape. During the casting run, a liquid-solid interface defines molten material head and solid material portions of the casting. The electromagnetic containing and forming device includes an inductor for applying a magnetic field to the molten material. The magnetic field defines a containment zone for the molten material. An alternating current is applied to the inductor to generate the magnetic field. The improvement comprises controlling the location of the liquid-solid interface in the containment zone. The location of the liquid-solid interface along the periphery of the casting is monitored. In response to the monitored location, the volume of molten material in the containment zone is changed so as to keep the location of the liquid-solid interface substantially constant.

The invention and further developments of the invention are now elucidated by means of the preferred embodiment shown in the drawing:

The FIGURE is an illustration of an electromagnetic casting system in accordance with the present invention.

The present invention relates to the automatic control of the position of the liquid-solid interface of a casting in an electromagnetic casting mold. This control enhances the production of a casting of superior desired shape, quality, and metallurgical structural tolerances.

In accordance with the present invention, an electromagnetic casting system 10 for casting materials is provided. The system comprises an electromagnetic casting mold 12 for electromagnetically containing and forming molten material during a casting run into a casting 14 of desired shape. During the casting run, the casting includes a liquid-solid interface 16 defining molten material head 18 and solid material 20 portions of the casting 14. The electromagnetic containing and forming device 12 includes an inductor 22 for applying a magnetic field to the molten material. The magnetic field defines a containment zone 24 for the molten material. A power supply device 26 applies an alternating current to the inductor to generate the magnetic field. The improvement comprises a device 28 for controlling the location of the liquid-solid interface 16 in the containment zone 24. The location control device includes an apparatus 30 for monitoring the location of the liquid-solid interface along the periphery of the casting. Also, the location control device includes an apparatus 32 responsive to the monitoring device 30 for changing the volume of molten material in the containment zone 24 so as to keep the location of the liquid-solid interface substantially constant.

Referring to the FIGURE, there is shown an electromagnetic casting system 10 in accordance with the present invention. An electromagnetic casting mold 12 may include an inductor 22 for generating an electromagnetic force field to contain and shape the molten material being cast. The inductor 22 may be of a type generally known and described in the prior art and which contains a cooling manifold. The inductor may be driven by an alternating current from a power source 26 of the type known in the prior art to produce the electromagnetic force field. The magnetic field interacts with the molten material in the casting zone 24 of the inductor to produce eddy currents within the molten material. These eddy currents interact with the magnetic field and produce forces which apply a magnetic pressure to the molten material to contain it so that it solidifies in a desired ingot cross section. During the casting process, an air gap "d" exists between the molten material and the inductor. A conventional control circuit 33, of the type described in U.S. Pat. No. 4,161,206 to Yarwood et al., may be provided to control the power supply 26. The purpose of the control circuit 33 is to insure that the gap "d" is maintained substantially constant so that only minor variations, if any, occur.

The molten material is formed or molded into the same general shape as the inductor to provide the desired ingot cross section. The inductor may have any desired shape including circular or rectangular as required to obtain the desired ingot cross section. The inductor 22 is preferably maintained in a fixed non-movable position while other mold elements move with respect to the inductor. However, it is within the scope of the present invention to move the inductor with respect to the other mold elements if desired.

A non-magnetic shield 34 may be provided within the inductor 22 to fine tune and balance the magnetic pressure with the hydrostatic pressure of the molten material. The non-magnetic shield is preferably a separate element as shown. However, it is within the scope of the invention to incorporate it as a unitary part of the coolant applying device 36 described below. Non-magnetic shields are known in the prior art and are normally of fixed geometry and are positioned above the liquid-solid interface between the primary inductor and the molten material and act to attenuate the magnetic field generated by the primary inductor. Currents are induced within the shield and attenuate the field at the molten material surface. The impedance of the shield reflects both its inductance and resistance. The inductance depends on the air gaps between the inductor and the shield and the shield and the ingot; resistance depends on the geometry and resistivity of the shield. Although it is generally known to position the shield in a particular location, it is within the scope of the present invention to move the shield in the casting mold 12.

A coolant applying device 36 for controlling the position of coolant contact and the amount of coolant applied to the casting includes a coolant manifold 38. Manifold 38 may be supported for movement independently of the inductor 22 and the non-magnetic screen 34 so that the position of a discharge port 40 can be adjusted axially of the ingot without a concurrent movement of the non-magnetic screen or the inductor. A movable cooling manifold, of the type shown in FIG. 1, is known in the prior art and disclosed and more fully explained in U.S. Pat. No. 4,158,379 to Yarwood et al.

The present invention further provides a coolant manifold positioning device 42 which may be comprised of a threaded rod 44 extending through a threaded hole within a support plate 45. One end of the rod 44 is rotatably connected to a support plate 46 which is affixed to the cooling manifold 38. The other end of the rod 44 may be secured to a stepping motor 48 which rotates rod 44. In addition, the cooling manifold includes an electrically actuated flow valve 49 which is in the coolant inlet line 50 to control the flow rate and/or continuity of coolant application of coolant passing through the cooling manifold. This may provide control of heat extraction from the ingot to raise or lower the axial position of the solidification front as known in the prior art and disclosed and more fully explained in U.S. patent application No. 4,388,962 to Yarwood et al.

In operation, the stepping motor turns the rod 44 and causes the cooling manifold 38 to move axially in the direction of casting closer or further away from the top surface of inductor 22. The valve 49 may also be adjusted to control the solidification front in a number of ways including intermittent pulsed application of the coolant or by intermittently changing the flow rate of the coolant in a pulsed manner. Although a particular type of cooling manifold, positioning device and flow valve is described, it is within the terms of the present invention to use any suitable cooling manifold and positioning apparatus.

A second coolant applying device 56 having a lower coolant manifold 51 may be provided, below the inductor 22, to provide additional cooling to the cast ingot if desired. Manifold 51 may be moved by a positioning device 52, including a stepping motor, threaded rod, and support plate similar to the positioning device 42 of the upper cooling manifold 38. Further, a flow valve 53, similar to valve 49, is provided in the coolant inlet line 54. The lower coolant manifold 51 may be positioned and operated in the same manner as valve 49 described above in accordance with the particular size and material being cast.

The present invention includes a device 55 for controlling the flow rate of the molten material into the casting mold. The control of the molten material flowing into the containment zone 24 of the inductor provides a means to change the volume of molten material head in the containment zone so as to keep the location of the liquid-solid interface substantially constant. The molten head 18, corresponding to the pool of molten material arranged above the solidifying ingot 20, exerts hydrostatic pressure in the magnetic containment zone. In a vertical casting apparatus 12 as illustrated in the FIGURE, the molten head 18 extends from the top surface 60 of the molten pool to the solid-liquid interface or solidification front 16 and further includes a limited contribution associated with the molten material in and above the downspout 64 and and trough 66.

The preferred embodiment of the present invention utilizes a metal distribution system including a downspout 64 and a trough 66. The downspout 64 is supported above the casting zone and extends thereto. A trough 66 is located at the upper end of the downspout. A flow control valve 68 is provided in the metal distribution system which leads to the mold. The flow control valve 68 shown comprises a pin 70 which is arranged to control the flow rate of molten material from the trough 66 into the downspout 64. A valve actuator 72 may include a pneumatic actuator to move the pin 70 up or down in accordance with air introduced or withdrawn by a voltage-to-pressure transducer 74. The details of this type of system are more fully described in U.S. patent application Ser. No. 110,893 now abandoned.

A conventional ram 80 and bottom block 82 may be provided to withdraw the ingot from the containment zone at a predetermined speed. The ram 80 and the bottom block 82 may be operated by a conventional hydraulic system 84 which can control the direction of movement of the ram and the speed at which the ram moves.

The present invention is concerned with the automatic control of essential elements of the electromagnetic mold and ancillary equipment in order to produce an ingot of superior desired shape, quality, and metallurgical structure. The essential mold elements and parameters are monitored, and adjustments are made in real time in order to stabilize the casting condition to preset values known from previous experimentation to generate the most desirable ingot or the particular metal, alloy or other material being cast. In the prior art as noted in the background of this application, various systems have been described with the aim of providing cast ingots by the electromagnetic casting process which have substantially uniform cross sections. Implicit and explicit in the techniques of the prior art is the need to control major variables in electromagnetic casting in order to control various aspects of ingot geometry and metallurgical quality. However, as discussed below, it is often desirable to control several variables simultaneously, and it is highly desirable to control these variables in real time rather than to make periodic adjustments as between casts or at widely spaced intervals during a cast. The present invention recognizes this need and teaches the use of an integrated control system desired to fill this gap in electromagnetic casting technology.

The single most important parameter to be controlled in electromagnetic casting is the air gap d between the inductor and ingot at the liquid-solid interface. The air gap d describes the geometry of the ingot as it relates to the fixed inductor shape. If d is held constant with time around the containment periphery, a desirable constant section ingot is obtained. The value of d is determined by the balance of the magnetic force generated by the inductor current i and the liquid-metal head $h_l$. It is known in the art to hold the air gap d constant by electronic feedback loops as taught by Yarwood et al. in U.S. Pat. No. 4,161,206. In order for this technique to operate effectively, liquid-solid interface height $h_s$ and the liquid metal head $h_l$ should preferably be controlled within specific limits.

The liquid-solid interface $h_s$ should preferably be positioned where the field strength (for the required air gap d) is maximum. Although this is typically about mid-inductor height, the magnetic shield 34 or other factors may alter its location. Such an arrangement tends to minimize containment power for any given electromagnetic casting equipment setup. Furthermore, constant $h_s$ is preferred in order to generate a uniform desirable metallurgical structure in the ingot.

Since the present invention is particularly concerned with the control of the interface position, it is, of course, necessary to provide a technique or apparatus to monitor the location of the liquid-solid interface along the periphery of the casting. The location of the interface may be constantly monitored by a system such as the type disclosed in U.S. Pat. No. 4,321,922.

The monitoring apparatus 30 includes an infrared sensitive sensor array 90 fabricated by mounting a plurality of optic filaments 92 in the electromagnetic inductor 22 as shown. Preferably, the filaments 92 are dispersed in a spiral arrangement over a quadrant or a portion thereof so as to go up the inductor in a helical fashion that is displaced angularly by some amount. Further, if desired, the filaments may be arranged in many different arrays and through other portions of the mold as more fully described in the Ungarean application. In addition, the optic filaments may also be provided in the screen 34, as shown, to measure the height of the molten surface.

Monitoring apparatus 30 also includes a signal processor 94 which is fed the radiation information to compute the temperature and temperature gradient along the surface of the casting. The processor may be divided into two sections, analog and digital. The purpose of the analog section is to convert the received radiation signal to a digital word or location signal. The signal scaling, linearizing, pattern recognition, controlling and computation may be done within the digital portion of the signal processor. The digital portion of the processor 94 can be implemented with a standard microprocessor system or a dedicated logic network.

In general, the temperature and gradient of the load will gradually increase from something less than the liquidus value at the solidification zone to something near the melt temperature at the top of the ingot. This can be sensed by measuring apparatus and knowing the basic sensor spacing. The temperature and gradient can be calibrated as a function of distance relative to some datum such as the bottom of the inductor 22. Above the top of the ingot, the temperature and gradient will drop off quite rapidly. Thus, the melt surface will be located at a point of maximum temperature and maximum gradient. In a similar fashion, the solidification zone can be located. That is, at the solidification zone the temperature gradient should change from a small positive slope to one much larger. Then, by coincidence of this gradient change with the melt surface temperature, both actual and theoretically expected, the solidification zone can be estimated. Although an infrared system has been used to determine the position of the solidification front and if desired the top surface of the ingot being cast, it is also within the scope of the present invention to use any other desired techniques such as disclosed in U.S. patent application Ser. No. 137,645 described hereinabove.

The present invention also includes a device 32 which is responsive to the monitoring device 30 for changing the volume of molten material in the containment zone so as to keep the location of the liquid-solid interface substantially constant. The controller 32 may be a circuit device which is adapted to receive the sensed liquid-to-solid interface location signal and to compare it with a predetermined value thereof to generate an error signal for controlling the transducer 74. In addition, the controller 32 may also serve to control the manifold positioning devices 42 and 52 as well as the flow control valves associated therewith. Although the preferred embodiment of the present invention provides control of the coolant application apparatus by the control circuit device 32, it is within the scope of the present invention to operate the coolant application apparatus devices by other means such as manually. The control device 32 may be a standard microprocessor system or a dedicated logic network.

It is a unique aspect of this invention that a change in the location of the liquid-to-solid interface is utilized to control the flow rate of molten metal into the containment zone of the casting device 10. In order to further understand this invention, a description of its operation follows. A desired set point is located along the axial direction of the inductor at approximately the center of the maximum magnetic field. This set point may be previously calculated in accordance with the material and size of the casting. The information can be programmed into the circuit 32 by any desired means such as for example typing, punch card, or magnetic card. Alternatively, the circuit 32 may be set to store the information required for any desired set of parameters.

In the event that the liquid-solid interface $h_s$ at the periphery of the ingot begins to move upward in the containment zone, away from the maximum magnetic field, the effect would be a decrease in the hydrostatic pressure exerted by the molten material. The power controller 33 would respond by changing the current generated by power generator 26 to power the inductor 22. As the volume of the liquid load decreases, the heat input into the system also decreases and a freeze-up can occur due to insufficient heat within the containment zone. This may result in inferior quality ingots or possibly a breakdown in the operation of the electromagnetic casting device. Therefore, it is quite important that this problem be quickly alleviated. The change in the position of the liquid-solid interface may be constantly monitored by the infrared array 92 and relayed to the monitoring equipment 94 through line 100. The monitoring circuit 94 transmits a location signal indicating the position of the liquid-solid interface to the control structure 32. In the situation where the liquid-solid interface is rising, the control circuit signals the pressure transducer 74 through line 102 to open the valve device 68 and increase the flow of molten material into the containment zone. As the volume of the molten material forming the molten material head 18 increases, the heat input into the system also increases and the liquid-to-solid interface begins to move back down towards the desired set point at approximately the maximum magnetic field. Once the liquid-to-solid interface has reached the desired preset location, the circuit 32 can again signal the transducer 74 to reset the flow control 68 so that the molten material head $h_l$ returns to a desired height in accordance with the requirements for maintaining the gap "d" with the desired power level from the power generator 26. The height of molten material is a function of the casting speed and can be monitored with the sensors in the shield.

When the interface $h_s$ moves downward in the containment zone, the hydrostatic pressure head increases and requires greater power to maintain the gap "d" constant. The increased volume of molten material may reach a point where the inductor is not able to generate a field sufficient to support the liquid load and the result would be a spillout of the molten material. Again, the present invention provides constant monitoring of the position of the liquid-solid interface by the infrared sensors, and this information is directed by the monitoring circuit 94 to the control circuit 32. The control circuit operates to compare the position of the liquid-solid interface (which in the instant case is lower in the containment zone than the predetermined location of maximum magnetic field) to the set point and signal the transducer 74 to operate the flow control 68 so as to decrease the molten material flowing into the containment zone 24. With a decrease in the volume of molten material, the heat input also goes down and the liquid-to-solid interface $h_s$ begins to rise in the containment zone. When $h_s$ reaches the desired set point, the controller 32 signals the transducer to reset the flow control 68 so that the molten material head returns to its most advantageous height for the proper power level needed to power the inductor 22.

The present invention may also be operated as a priority system. The only difference from the first embodiment would reside in the control circuit 32. Accordingly, no additional drawing has been provided for the second embodiment. The control circuit 32 may be provided with an override control circuit incorporated therein. This override control circuit activates the voltage pressure transducer 74 when the liquid-solid interface $h_s$ varies more than about a desired percentage of the length of the inductor from the desired set point as more fully described below. The control circuit 32 receives a location signal from the monitoring device 30 as described hereinabove. In a first mode of operation, the circuit 32 signals the coolant applying devices 36 and/or 56 to apply the coolant to the casting so as to vary the heat extraction rate from the casting for solidifying the molten material at a rate required to maintain the liquid solidification front at the periphery of the casting substantially constant at a desired position. This mode of operation is desirable when the location of the liquid-solid interface varies less than about a desired percentage of the height of the inductor from a desired set point. This percentage is most preferably about 6.5% of the height of the inductor but may be approximately 12.5% or even approximately 25% of the height. The control circuit 32 may vary the application of the coolant by a number of means. For instance, the coolant may be applied with a pulsed flow which may comprise intermittent periods of coolant flow with periods of no coolant flow in between. Alternatively, the flow of coolant may comprise intermittent periods of coolant flow at a first rate of flow with periods of coolant flow at a second rate of flow different from the first rate between the periods of said flow at said first rate. The control circuit may provide the pulsed flow by adjustment of the flow valves 49 and/or 53 through lines 104 and 106, respectively. Another alternative for controlling the heat extraction rate is by repositioning the discharge coolant ports in the manifolds 38 and/or 51 for directing the coolant against the casting at a different position along the periphery of the casting. The circuit 32 may adjust the position by applying signals through lines 108 or 110 to positioning devices 42 and 52, respectively. By changing the coolant rate or the position of the coolant application to the periphery of the casting, the location of the liquid-solid interface may be altered without directly modifying the magnetic field produced by the inductor 22. The desired combination of the upper or lower manifold and the coolant rate and the position of the coolant application to the casting is a matter which is determined and programmed into the control circuit 32 depending on factors such as the material and size of the ingot being cast. In a second mode of operation, once the liquid-to-solid interface varies more than about a desired percentage of the length of the inductor from the desired set point, the override control portion of circuit 32 sends a signal through line 102, as described above, to change the volume of molten material in the containment zone until the liquid-solid interface returns to approximately the desired set point. In mode two operation, the coolant applying devices are operated concurrently with the material volume change. When the liquid-solid interface returns to about the desired set point, the override aspect of control 32 signals the transducer to reset the flow control 68 so that the molten material head returns to its most advantageous height for the proper power level needed to power the inductor 22. The device 32 then cycles back to operate in the mode one manner.

In changing the height of the liquid head $h_l$, a limitation exists in that the top surface 60 cannot be raised to a height outside of the containment zone established by the magnetic field of the inductor 22. In the event that the surface 60 rises above the containment zone, the molten material will spill over and thereby ruin the ingot as well as possibly damage the equipment. Therefore, the infrared sensing system, which may include sensors in the shield as shown, is able to transmit to the circuit 94 the position of the top surface 60. This information can be fed to the control system 32 which can limit the amount of molten material fed into the containment zone so that the head height does not go beyond a desired limit location. Alternatively, a lower limit on the liquid head may also be provided in the same manner to prevent a freeze-up condition when $h_l$ becomes too small.

While the invention has been described with reference to molten materials, it can be applied to a wide range of metals, alloys, semi-metals, and semi-conductors including nickel and nickel alloys, steel and steel alloys, aluminum and aluminum alloys, copper and copper base alloys, silicon, germanium, etc. These materials are mentioned by way of example, and it is not intended to exclude other metals, alloys, metalloids, or semi-metal type materials.

It is apparent that there has been provided in accordance with this invention an electromagnetic casting system which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. In a process for casting materials, comprising the steps of:

electromagnetically containing and forming molten material during a casting run into a casting of desired shape, delivering molten material at a set flow rate into the containment zone whereby a desired height of molten material is established, said casting including during said casting run a liquid-solid interface defined by molten material head and solid material portions of said casting;

providing an inductor for applying a magnetic field to said molten material, said magnetic field defining a containment zone for said molten material, applying an alternating current to said inductor to generate said magnetic field, and applying coolant to said casting for solidifying the molten material, the improvement comprising the steps of:

automatically maintaining the location of the liquid-solid interface at a desired set point in said containment zone, said location maintaining step comprising the steps of:

continuously sensing the location of said liquid-solid interface along the periphery of said casting;

responsive to said sensing step in a first mode of operation when the liquid-solid interface varies from said desired set point less than a desired percentage of the length of the inductor, controlling said coolant while maintaining the flow rate of molten material into the containment zone substantially constant in a manner to keep the location of the liquid-solid interface substantially constant; and responsive to said sensing step in a second mode of operation when the liquid-solid interface varies from said desired set point more than said desired percentage, changing the flow rate of molten material delivered to the containment zone and adjusting the coolant in a manner so as to return the location of the liquid-solid interface to said desired set point, and responsive to said liquid-solid interface returning to said desired set point, cycling back to the first mode of operation.

2. The process as in claim 1 wherein said step of applying coolant includes the step of controlling the position at which the coolant is applied to the periphery of the casting so as to control the location of the liquid-solid interface.

3. The process as in claim 2 wherein in said second mode of operation when said liquid-solid interface moves upward in the containment zone more than said desired percentage, the flow rate of molten material delivered to the containment zone is increased until the liquid-solid interface returns to approximately said desired set point.

4. The process of claim 3 wherein in said second mode of operation when the liquid-solid interface moves downward in the containment zone more than said desired percentage, the flow rate of molten material delivered to the containment zone is decreased until the liquid-solid interface returns to approximately said desired set point.

5. The process as in claim 4 wherein said desired set point is located at approximately the center of the maximum magnetic field.

6. The process of claim 5 wherein said desired percentage is approximately 25%.

7. The process of claim 6 wherein said desired percentage is approximately 12.5%.

8. The process of claim 7 wherein said desired percentage is approximately 6.25%.

* * * * *